US006477938B1

(12) United States Patent
Nakayama et al.

(10) Patent No.: US 6,477,938 B1
(45) Date of Patent: Nov. 12, 2002

(54) SEMI-SPHERICAL SHOE

(75) Inventors: Seiichi Nakayama, Toyota (JP); Shogo Muramatsu, Toyota (JP); Akira Takenaka, Toyota (JP)

(73) Assignee: Taiho Kogyo Co., Ltd., Toyota (JP)

( * ) Notice: Subject to any disclaimer, the term of this patent is extended or adjusted under 35 U.S.C. 154(b) by 0 days.

(21) Appl. No.: 09/889,709

(22) PCT Filed: Nov. 24, 2000

(86) PCT No.: PCT/JP00/08267

§ 371 (c)(1),
(2), (4) Date: Jul. 18, 2001

(87) PCT Pub. No.: WO01/38732

PCT Pub. Date: May 31, 2001

(30) Foreign Application Priority Data

Nov. 26, 1999 (JP) ..... 11-335609

(51) Int. Cl.[7] ..... F01B 3/00
(52) U.S. Cl. ..... 92/71; 74/60
(58) Field of Search ..... 92/71, 159, 160; 74/60

(56) References Cited

U.S. PATENT DOCUMENTS 4,138,775 A * 2/1979 Takaoka et al. ..... 29/156.4 R
4,683,804 A * 8/1987 Futamura et al. ..... 92/71
5,074,768 A * 12/1991 Kawamura et al. ..... 417/571
5,483,867 A * 1/1996 Ikeda et al. ..... 92/71
5,875,702 A * 3/1999 Kawagoe et al. ..... 92/12.2
5,943,941 A * 8/1999 Kato et al. ..... 92/12.2
6,192,784 B1 * 2/2001 Kato et al. ..... 92/71
6,308,615 B1 * 10/2001 Takenaka et al. ..... 92/129
6,378,415 B1 * 4/2002 Sugiura et al. ..... 92/71

* cited by examiner

*Primary Examiner*—Edward K. Look
*Assistant Examiner*—James M McAleenan
(74) *Attorney, Agent, or Firm*—Flynn, Thiel, Boutell & Tanis, P.C.

(57) ABSTRACT

A semi-spherical shoe 1 includes a semi-spherical surface 1A and an end face 1B. The semi-spherical surface 1A comprises a sliding contact region 1*a* which is disposed in sliding contact with a semi-spherical recess 2B formed in a piston 2, and non-sliding contact regions 1*b*, 1*b*' which are not disposed in sliding contact with the semi-spherical recess 2B. The non-sliding contact regions 1*b*, 1*b*' have a surface roughness greater than the surface roughness of the sliding contact region 1*a*. The non-sliding contact regions 1*b*, 1*b*' function as a lead-in of a lubricant oil to the sliding contact region 1*a*. As a consequence, there is provided a semi-spherical shoe 1 having an excellent sliding response as compared with a conventional arrangement in which the semi-spherical surface 1A has a uniform surface roughness over the entire region thereof.

5 Claims, 4 Drawing Sheets

SEMI-SPHERICAL SHOE

FIELD OF THE INVENTION

The invention relates to a semi-spherical shoe and more particularly, to a semi-spherical shoe which is preferred to be interposed between a piston of a swash plate compressor and a swash plate.

BACKGROUND OF THE INVENTION

The use of the semi-spherical shoe in a swash plate compressor which is provided with a semi-spherical surface and a flat end face is known in the art.

In the prior art practice, the entire semi-spherical surface of the semi-spherical shoe has been formed substantially to a uniform surface roughness. The semi-spherical shoe has its semi-spherical surface fitted into a semi-spherical recess formed in the piston and thus is disposed in sliding contact therewith. However, the entire semi-spherical surface is not disposed in sliding contact with the semi-spherical recess in the piston, but it is known that an annular region which is disposed toward the axial center of the semi-spherical shoe is disposed in sliding contact with the semi-spherical recess. Thus, the semi-spherical surface of the semi-spherical shoe includes a sliding contact region which is disposed in sliding contact with the semi-spherical recess in the piston, and a non-sliding contact region which is not disposed in sliding contact with the semi-spherical recess in the piston as is known in the art.

In the conventional semi-spherical shoe, the entire semi-spherical surface, thus, both the sliding contact region and the non-sliding contact region are formed to the same surface roughness. However, it is found by a study of a conventional semi-spherical shoe by the present inventor that a fine roughness of the semi-spherical surface has been effective in view of the sliding response. On the contrary, when the surface roughness of the semi-spherical surface is fine, the semi-spherical surface repels a lubricant oil, and thus there results a disadvantage that the lubricant oil is less susceptible to be guided toward the sliding contact region.

DISCLOSURE OF THE INVENTION

In view of the foregoing, the present invention provides a semi-spherical shoe including a semi-spherical surface which is fitted into a semi-spherical recess formed in one of members and an end face which is disposed in sliding contact with a flat surface formed on another member, in which a non-sliding contact region of the semi-spherical surface which is not disposed in sliding contact with the semi-spherical recess has a roughness which is greater than the roughness of a sliding contact region of the semi-spherical surface which is disposed in sliding contact with the semi-spherical recess.

With this arrangement, the greater surface roughness of the non-sliding contact region area than the surface roughness of the sliding contact region of the semi-spherical surface prevents a lubricant oil from being repelled by the non-sliding contact region, and allows the lubricant oil to be smoothly supplied to the sliding contact region through the non-sliding contact region. Because the sliding contact region has a fine surface roughness, there is provided a semi-spherical shoe which exhibits an excellent sliding response.

BEST MODES OF CARRYING OUT THE INVENTION

Figure 1:
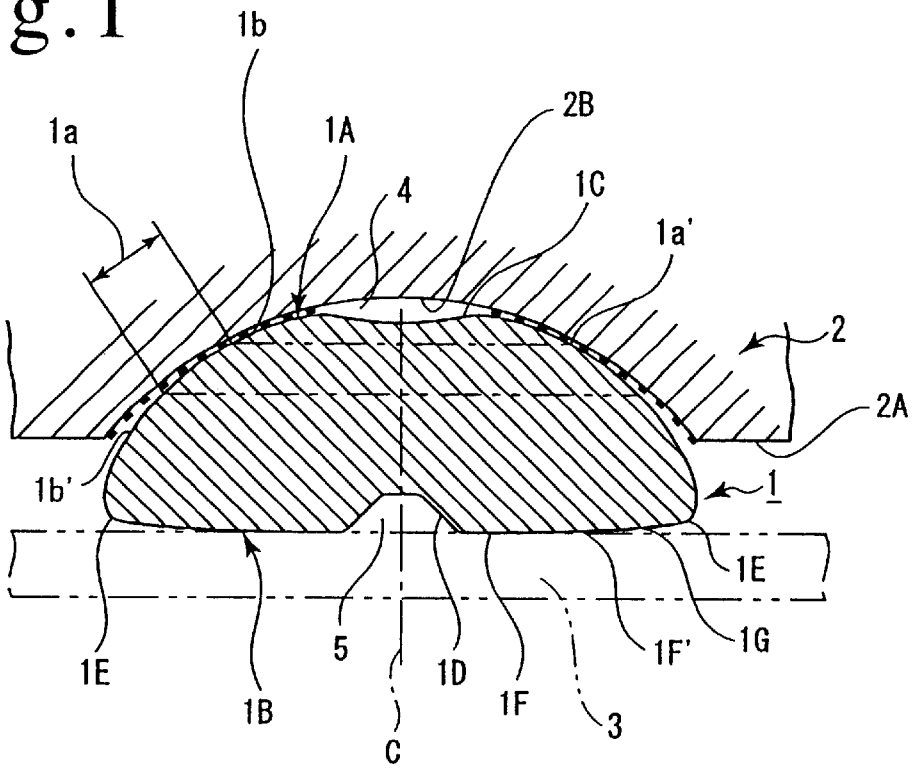
FIG. 1 is a cross section of one embodiment of the present invention.
Figure 2:
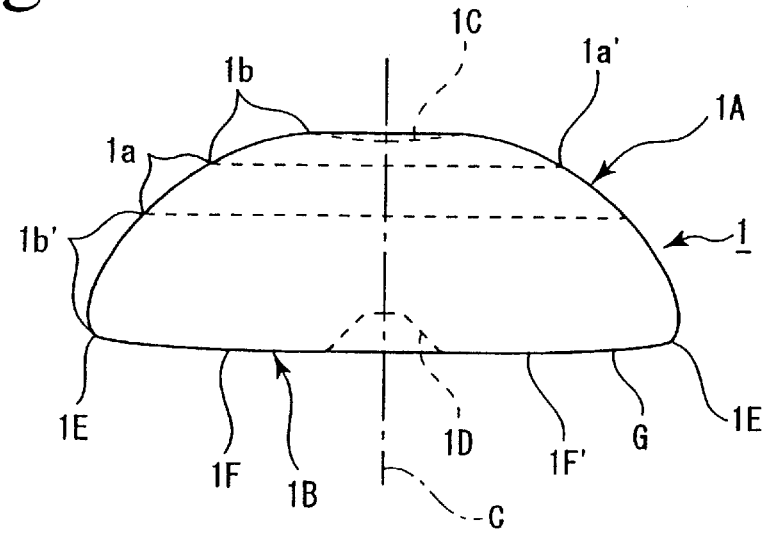
FIG. 2 is a front view of the semi-spherical shoe shown in FIG. 1.
Figure 3:
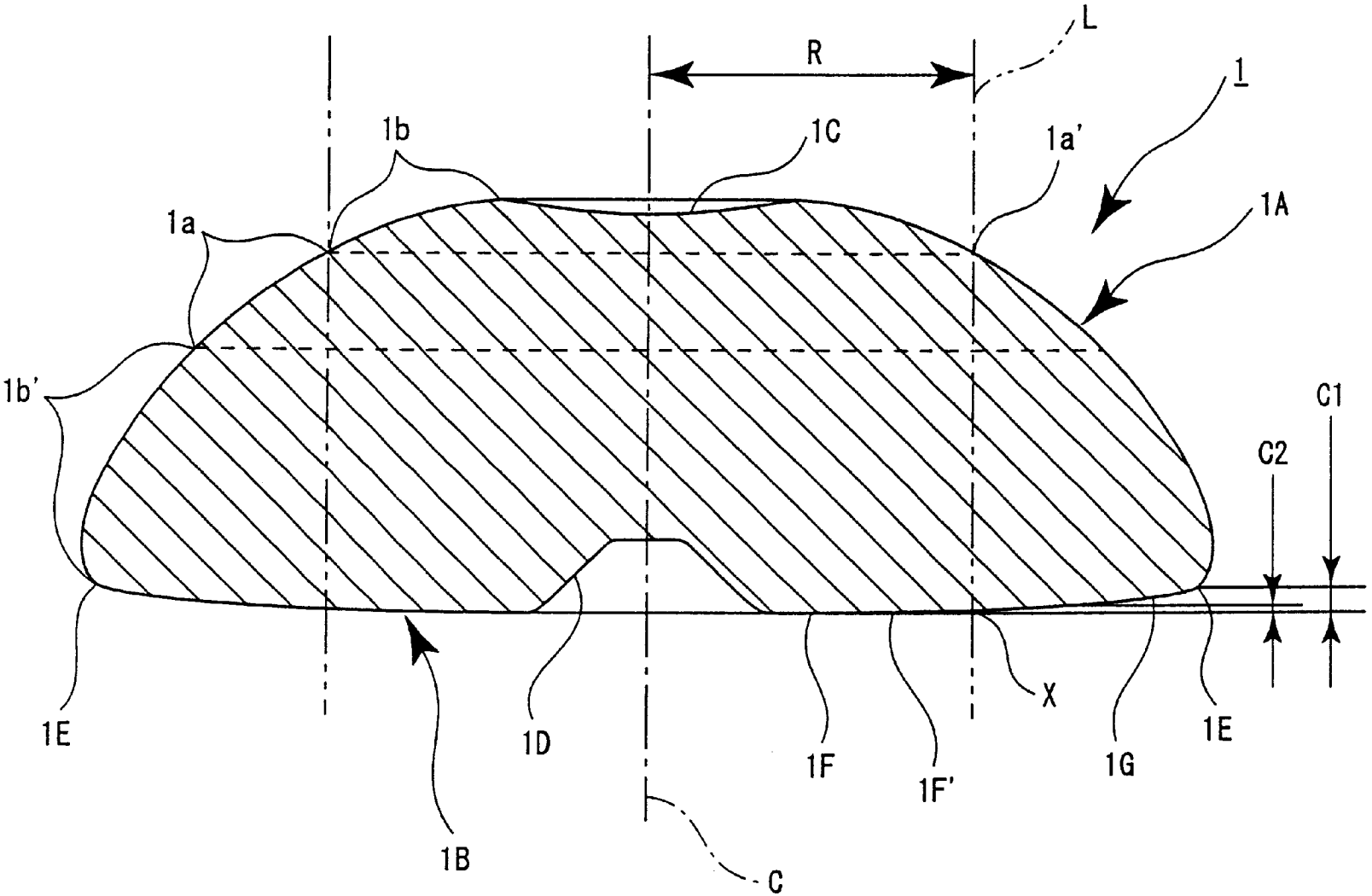
FIG. 3 is an enlarged view of the semi-spherical shoe shown in FIG. 1.

Several embodiments of the invention shown in the drawings will now be described. Referring to FIGS. 1 to 3, there is shown a semi-spherical shoe 1 which is disposed within a swash plate compressor which is in itself known in the art.

A swash plate compressor comprises a piston 2 which is disposed for reciprocating motion in the vertical direction as viewed in FIG. 1, and a flat swash plate 3 which is disposed for rotation by a rotary shaft. The piston 2 has an end face 2A, in which a semi-spherical recess 2B is formed. In this embodiment, the semi-spherical recess 2B is formed to exhibit a uniform curvature over the entire region thereof.

The semi-spherical shoe 1 includes a semi-spherical surface 1A and a flat end face 1B. At its top end, as viewed in FIG. 1, the semi-spherical surface 1A is slightly notched in a direction perpendicular to an axis C to define a shallow recess 1C which is arcuate in section. The end face 1B is formed with a substantially conical opening 1D toward the center or in alignment with the axis. The recess 1C formed at the top has a depth which is chosen to be on the order of about one-third the depth of the opening 1D in the end face 1B.

The semi-spherical shoe 1 is disposed so that the semi-spherical surface 1A is fitted into the semi-spherical recess 2B in the piston 2 while the end face 1B abuts against the swash plate 3. When the semi-spherical shoe 1 is interposed between the semi-spherical recess 2B and the swash plate 3, a region of the semi-spherical surface 1A which is located adjacent to a boundary 1E between the semi-spherical surface 1A and the end face 1B is exposed in a space between the end face 2A of the piston 2 and the swash plate 3 (see FIG. 1).

A space 4 is defined by the recess 1C and the semi-spherical recess 2B in the piston 2 while a space 5 is defined by the opening ID and the swash plate 3. These spaces 4 and 5 function as temporary reservoir chambers for the lubricant oil.

When the swash plate 3 rotates, the piston 2 is driven through the semi-spherical shoe 1 for reciprocating motion. At this time, the end face 1B of the semi-spherical shoe 1 slides relative to the swash plate 3 while the semi-spherical surface 1A slides relative to the semi-spherical recess 2B. During this process, the lubricant oil which is stored in the spaces 4 and 5 permeates into sliding contact regions of the semi-spherical surface 1A and the end face 1B, thus lubricating and cooling these regions.

In the present embodiment, the semi-spherical surface 1A includes a sliding contact region 1*a* and non-sliding contact regions 1*b*, 1*b*' having different surface roughnesses.

Specifically, the semi-spherical surface 1A of the semi-spherical shoe 1 is not entirely in sliding contact with the semi-spherical recess 2B in the piston 2, but only the annular region located adjacent to the top recess 1C or the sliding contact region 1*a* is disposed in sliding contact with the semi-spherical recess 2B. In other words, regions of the semi-spherical surface 1A except for the sliding contact region 1*a*, namely, a region between the sliding contact region 1*a* and the recess 1C (or non-sliding contact region 1*b*), and a region located between the boundary 1E and the sliding contact region 1*a* (or non-sliding contact region 1*b*') are not in sliding contact with the semi-spherical recess 2B.

In the present embodiment, the sliding contact region 1*a* of the semi-spherical surface 1A has a roughness which is finer than the non-sliding contact regions 1*b*, 1*b*'. Stated differently, the roughness of the non-sliding regions 1*b*, 1*b*' is greater than the roughness of the sliding contact region 1*a*.

More specifically, in the present embodiment, the surface roughness of the sliding contact region 1*a* is chosen to be equal to or less than 0.8 $\mu$mRz (or more preferably 0.2 $\mu$mRz). By contrast, the surface roughness of the non-sliding contact regions 1*b*, 1*b*' is chosen to be equal to or less than 1.6 $\mu$mRz (or more preferably 0.4 $\mu$mRz). It is desirable that the roughness of the sliding contact region 1*a* be chosen to be equal to or less than 1.6 $\mu$mRz while the roughness of the non-sliding contact regions 1*b*, 1*b*' be chosen to be 3.2 $\mu$mRz.

The roughness of the non-sliding contact regions 1*b*, 1*b*' is achieved by a cutting operation. In addition to the cutting operation, a forging operation or a laser machining may be used to achieve a greater surface roughness of the non-sliding contact regions 1*b*, 1*b*' than the surface roughness of the sliding contact region 1*a*.

In the present embodiment, a region of the end face 1B of the semi-spherical shoe 1 which is located toward the axis (or opening 1D) is formed to bulge into the swash plate 3 as compared with the boundary 1E which defines the outer periphery of the semi-spherical shoe. A flat surface which is located toward the axis defines a region which is used as a sliding contact region 1F disposed in sliding contact with the swash plate 3.

On the other hand, a region extending from an outer edge 1F' of the sliding conduct region 1F to the boundary 1E is formed to depict a gentle arc in section, thus defining a non-sliding contact region 1G which is not disposed in sliding contact with the swash plate 3.

In the present embodiment, when forming the non-sliding contact region 1G, the outer edge 1F' of the sliding contact region 1F is located nearer the axis C as compared with a distance R (or radius) by which a top edge 1*a*' or the edge located toward the recess 1C of the sliding contact region 1*a* of the semi-spherical surface 1*a* is spaced from the axis C (see FIG. 3).

When an imaginary line L is drawn parallel to the axis C so as to intersect with the edge 1*a*', a point X where the line L intersects with the non-sliding region 1G, the sliding contact region 1F and the boundary 1E are chosen such that denoting a distance by which the sliding contact region 1F and the boundary 1E are spaced apart axially (or a bulge of the sliding contact region 1F) by C1 and a distance by which the sliding contact region 1F and the pointer X are spaced apart vertically by C2, the inequality $C2/C1 \leqq 0.3$ is satisfied.

In this manner, in the present embodiment, a region of the end face 1B located toward the axis (or sliding contact region 1F) bulges beyond the boundary 1E which defines the outer periphery.

Figure 4:
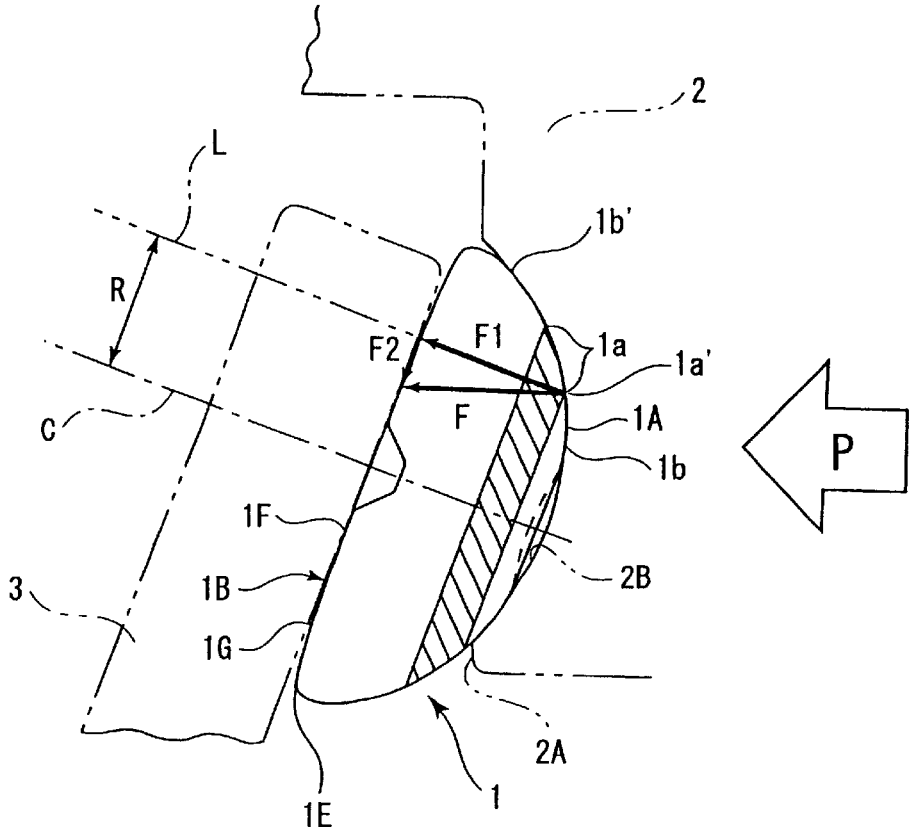
FIG. 4 shows the disposition of the semi-spherical shoe shown in FIG. 1 during the operation of a swash plate compressor.

In actual use of the semi-spherical shoe 1, a maximum load P applied to the piston 2 along the axis thereof is supported by the swash plate 3 which assumes its most skewed position and the sliding contact region 1F of the end face 1B, as shown in FIG. 4. Accordingly, the semi-spherical shoe 1 which is interposed between the semi-spherical recess 2B of the piston 2 and the swash plate 3 assumes a very stable position. In the condition shown in FIG. 4, part of the sliding contact region 1*a* of the semi-spherical surface 1A becomes exposed in a space between the end face 2A of the piston 2 and the swash plate 3, whereby the lubricant oil is guided into the region of sliding contact between the sliding contact region 1*a* and the semi-spherical recess 2B.

As mentioned above, in the semi-spherical shoe 1 of the present embodiment, the non-sliding contact regions 1*b*, 1*b*' have a surface roughness greater than the surface roughness of the sliding contact region 1*a*, and thus the non-sliding contact regions 1*b*, 1*b*' have a reduced tendency to repel the lubricant oil. Accordingly, the lubricant oil can be smoothly supplied to the sliding contact region 1*a* through the non-sliding contact regions 1*b*, 1*b*'.

On the other hand, the reduced surface roughness of the sliding contact region 1*a* achieves an excellent sliding response when it slides relative to the semi-spherical recess 2B in the piston 2.

Thus it will be seen that since the non-sliding contact regions 1*b*, 1*b*' having a greater surface roughness are effective to draw the lubricant oil into the sliding contact region 1*a* in the present embodiment, there is provided a semi-spherical shoe 1 having an excellent sliding response as compared with the conventional semi-spherical shoe 1 in which the semi-spherical shoe 1A has a uniform roughness over the entire region thereof As mentioned above, in the present embodiment, a region of the end face 1B located toward the axis (or the sliding contact region 1F) bulges to a greater degree than at the outer periphery (the non-sliding contact region 1G). As a consequence, the position of the semi-spherical shoe 1 during the operation of the swash plate compressor becomes stabilized, providing a good lubricating and cooling effect upon the sliding regions by the lubricant.

Second Embodiment

Figure 5:
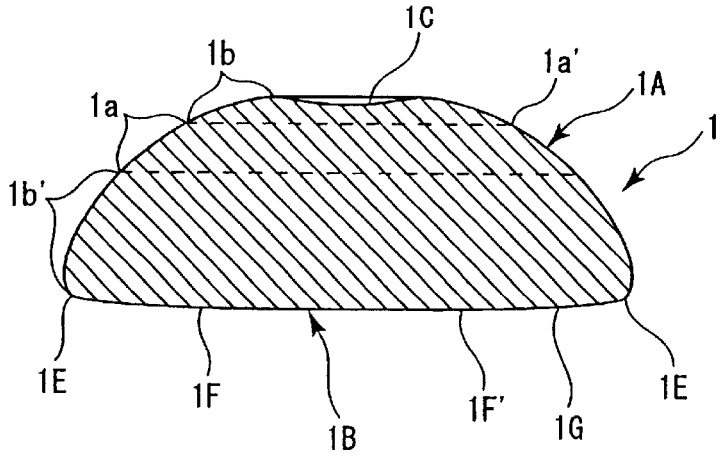
FIG. 5 is a cross section of a second embodiment of the invention.

FIG. 5 shows a second embodiment of the invention in which the opening 1D formed in the end face shown in the first embodiment is omitted. In other respects, the arrangement is similar to the first embodiment. Again, a similar functioning and effect can be achieved as a achieved in the first embodiment.

Third Embodiment

Figure 6:
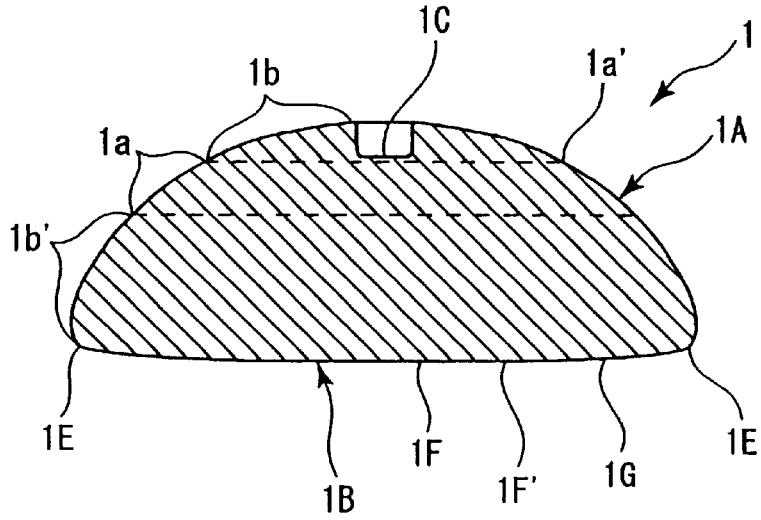
FIG. 6 is a cross section of a third embodiment of the invention.

FIG. 6 shows a third embodiment of the present invention in which the recess 1C shown in the second embodiment is provided by a opening 1C of a greater depth. In other respects, the arrangement is similar to the second embodiment. Again, a similar functioning and effect can be achieved as achieved in the first embodiment.

Fourth Embodiment

Figure 7:
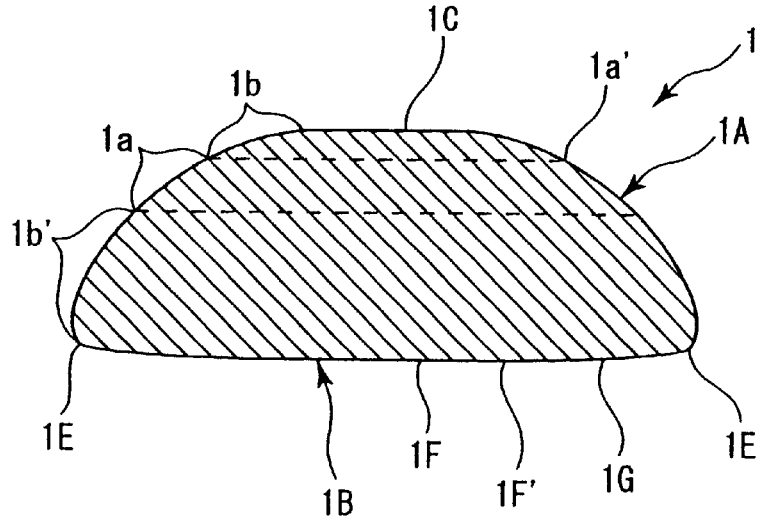
FIG. 7 is a cross section of a fourth embodiment of the invention.

FIG. 7 shows a fourth embodiment of the present invention in which the recess 1C shown in the second embodiment is replaced by a flat surface 1C which extends perpendicular to the axis. In other respects, the arrangement is similar to the second embodiment. Again a similar functioning and effect can be achieved as achieved in the first embodiment.

Above described embodiments illustrate the application of the present invention to the semi-spherical shoe of the swash plate compressor, but it should be understood that the shoe of the present invention can be used with a wobble plate oil pump. In addition, the shoe according to the present invention can also be used with a mechanical component having a semi-spherical recess into which the semi-spherical shoe is fitted.

As described above, in accordance with the invention, there is obtained an advantage that a semi-spherical shoe having an improved sliding response as compared with the prior art can be obtained.

What is claimed is:

1. A semi-spherical shoe including a semi-spherical surface which is fitted into a semi-spherical recess in a first members and an end face which is disposed in sliding contact with a flat surface on a second member, characterized in that the semi-spherical surface includes a non-sliding contact region which is not disposed in sliding contact with the semi-spherical recess and having a surface roughness greater than the surface roughness of a sliding contact region of the semi-spherical surface which is disposed in sliding contact with the semi-spherical recess.

2. A semi-spherical shoe according to claim 1 in which the sliding contact region has a surface roughness equal to or less than 1.6 $\mu$mRz while the non-siding contact region has a surface roughness equal to or less than 3.2 $\mu$mRz.

3. A semi-spherical shoe according to claim 1, in which the sliding contact region is defined between a top of the semi-spherical surface and the end face.

4. A semi-spherical shoe according to claim 1, in which a region of the end face which is disposed toward the axis bulges beyond a region of the end face which is disposed around the outer periphery thereof, the region of the end face disposed toward the axis being formed with a flat surface which is disposed in sliding contact with the flat surface on said second member.

5. A semi-spherical shoe according to claim 1, in which said first member comprises a piston of a swash plate compressor and said second member comprises a swash plate of the swash plate compressor.

* * * * *